United States Patent [19]

Gordon

[11] Patent Number: 4,462,414

[45] Date of Patent: Jul. 31, 1984

[54] COIN FEEDING DEVICE FOR SLOT MACHINES

[76] Inventor: George N. Gordon, 203 Missouri St., San Francisco, Calif. 94107

[21] Appl. No.: 389,025

[22] Filed: Jun. 16, 1982

[51] Int. Cl.[3] ..... G07D 1/08

[52] U.S. Cl. ..... 133/5 B; 194/1 E

[58] Field of Search ..... 194/1 E, 1 K; 221/276, 221/268, 271; 133/2, 5 A, 5 B, 1 A

[56] References Cited

U.S. PATENT DOCUMENTS

| | | | |
|---|---|---|---|
| 1,150,914 | 8/1915 | Whitcomb | 133/5 B |
| 2,158,608 | 5/1939 | Bogress . | |
| 2,790,450 | 4/1957 | Goldy . | |
| 3,343,553 | 9/1967 | Whitmore . | |
| 4,044,875 | 8/1977 | Greenwald et al. | 194/1 K |
| 4,165,802 | 8/1979 | Mathews | 194/1 K |

*Primary Examiner*—Stanley H. Tollberg
*Attorney, Agent, or Firm*—Robert W. Dilts

[57] ABSTRACT

The device includes structure defining a first passageway dimensioned to pass coins one at a time in edge-on orientation and structure defining a second passageway dimensioned to pass coins one at a time in edge-on orientation communicating with one end of the first passageway and extending transversely thereto. The junction between the first and second passageways is dimensioned to allow the faces of the coins to pivot by about 90° within such junction. The device also includes structure defining a tubular reservoir mentioned to receive a supply of coins in face to face stacked relationship with the tubular axis of the reservoir extending normally to the first passageway and with one end of the tubular reservoir opening into the first passageway. A slide member is received in the other end of the first passageway for reciprocating motion therewithin. The slide member has sufficient length to move a coin received in the first passageway from the reservoir into the junction between the first and second passageways. The tubular reservoir may be removable from the structure defining the first passageway in which case structure is provided for retaining coins in the reservoir against accidental discharge therefrom. According to one embodiment of this invention, the device may be formed integrally with the coin inlet structure of the slot machine and according to another embodiment of this invention, the device is adapted to be removably mounted on the coin inlet structure of the slot machine.

12 Claims, 13 Drawing Figures

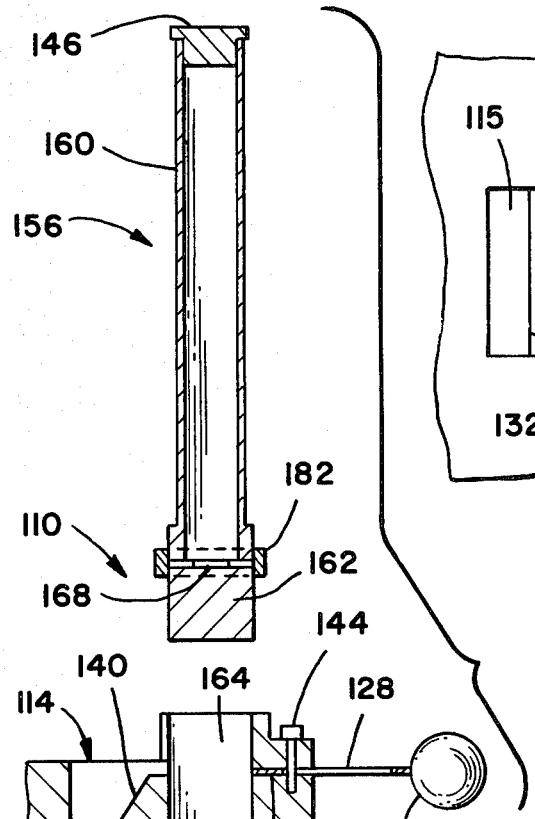
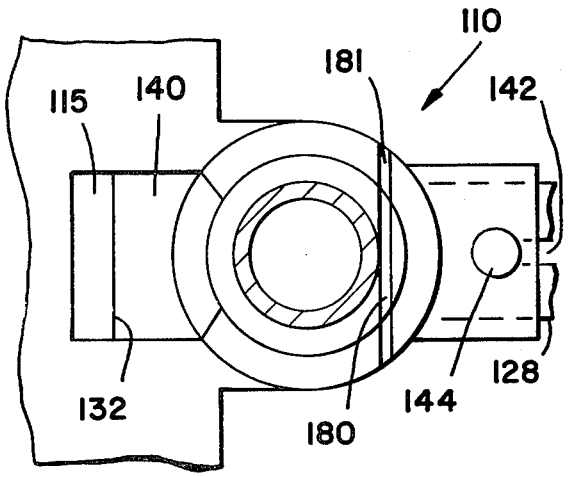
FIG _ 13
FIG _ 11
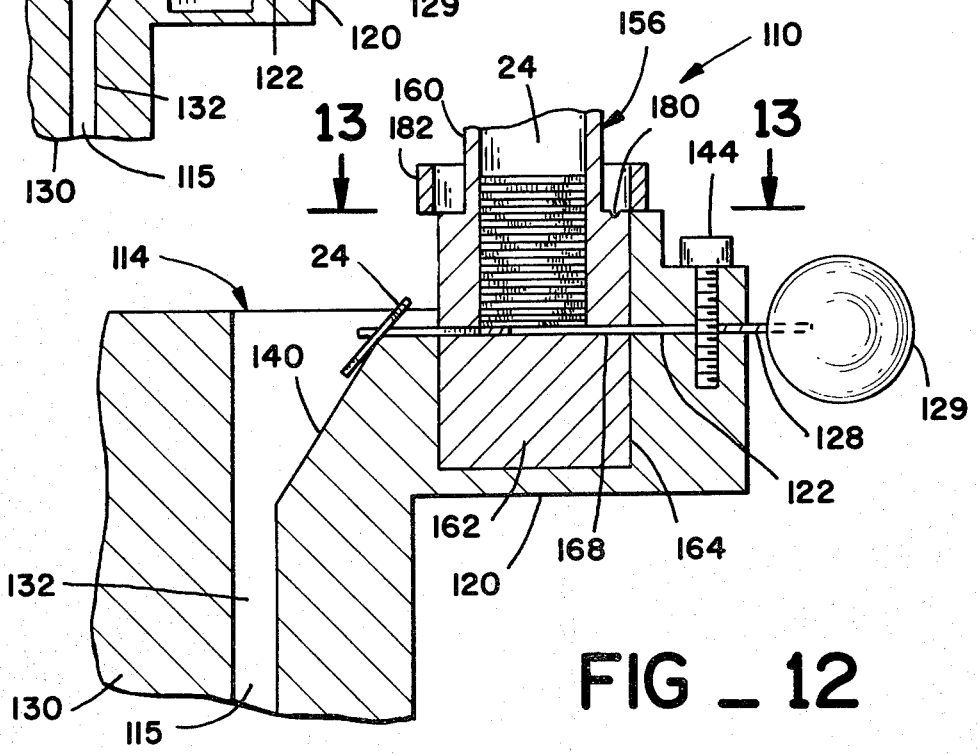
FIG _ 12

COIN FEEDING DEVICE FOR SLOT MACHINES

DESCRIPTION

1. Field of the Invention

This invention relates to a device for feeding coins into the coin inlet of slot machines and more particularly to such a device capable of feeding coins into such inlet one at a time from a contained stack.

2. Background of the Invention

Devices for guiding coins into the coin inlet structure of slot machines have been proposed in the prior art. Such devices have generally comprised a funnel member adapted to be removably mounted on the coin inlet structure of the slot machine. The player using such a device was expected to drop coins from a supply of coins, one at a time, into the funnel member for guidance into the coin inlet structure. Such devices have been effective in reducing the number of coins which are dropped on the floor in the process of being inserted into the slot machine together with the attendant loss, embarrassment, or accidental injury to the player.

However, where the supply of coins is held in that hand of the player used to insert the coins into the machine, there remains the possibility that more than one coin will be dropped in the funnel member inadvertently. This will either jam the device or the machine, or will result in the inadvertent playing for higher stakes than desired by the player.

Where the supply of coins is held in one hand of the player, either bare or in a cup or other reservoir, it is necessary for the player to transfer the coins one at a time from the supply to the funnel member of the prior art with the other hand. Thus, there is the chance that a coin will be dropped to the floor during transportation to the coin inlet. More importantly, there is a substantial danger that the entire supply of coins or some part thereof, will be dropped or spilled onto the floor with even greater loss, embarrassment or accidental injury during recovery of the coins.

It is the object of this invention to overcome the foregoing disadvantages of the prior art.

SUMMARY OF THE INVENTION

According to this invention, a device is provided for feeding coins one at a time from a supply of such coins into a slot machine having a coin inlet for receiving such coins one at a time in edge-on position for falling of the coin by gravity into the inlet. The device comprises means defining a first passageway of generally rectangular cross-section dimensioned to pass coins one at a time in edge-on orientation. Means are provided defining a tubular reservoir dimensioned to receive the supply of coins in face-to-face stacked relationship. The tubular axis of the reservoir extends normally to the major surfaces of the first passageway with one end of the reservoir opening into the first passageway through one of the major surfaces thereof. Means are also provided defining a second generally rectangular passageway dimensioned to pass coins in edge-on orientation communicating with one end of the first passageway. The second generally rectangular passageway extends transversely of the major surfaces of the first passageway and the end thereof remote from the first passageway communicates with the coin inlet of the slot machine. The junction between the second generally rectangular passageway and the first generally rectangular passageway is dimensioned to allow the faces of the coins to pivot by about 90° within such junction and a slide member is received in the other end of the first passageway for reciprocating motion therewithin, the slide member having sufficient length to move a coin received in the first passageway from the reservoir into the junction between the first and second passageways.

BRIEF DESCRIPTION OF THE DRAWING

This invention will be more fully understood from a reading of the following detailed description of preferred embodiments thereof in conjunction with the attached drawing wherein:

FIG. 11 is an exploded view in cross-section of an embodiment of this invention in which the operative portion of the device, as distinguished from the reservoir, may be fabricated as an integral part of the slot machine.

FIG. 12 is an enlarged fragmentary cross-section of the device of FIG. 11 as fully assembled for operation.

FIG. 13 is a cross-sectional view taken along lines 13—13 of FIG. 12.

DETAILED DESCRIPTION OF PREFERRED EMBODIMENTS

Figure 1:
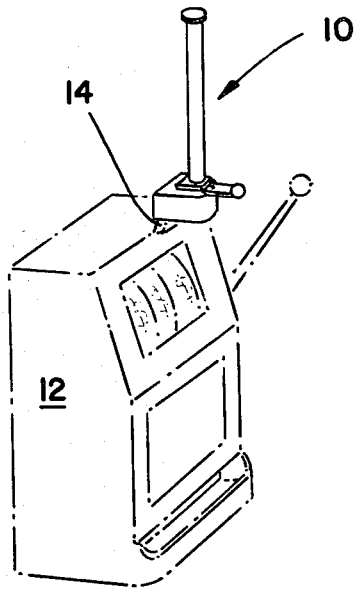
FIG. 1 is a perspective view showing a slot machine in phantom with a device according to this invention shown in full as mounted for use on the slot machine.

Referring to FIG. 1, a coin feeding device 10 according to this invention, for use with a conventional slot machine is shown in full perspective. A representative slot machine 12 is shown in phantom and the device is shown as mounted on the conventional coin inlet structure 14 of slot machine 12.

Figure 2:
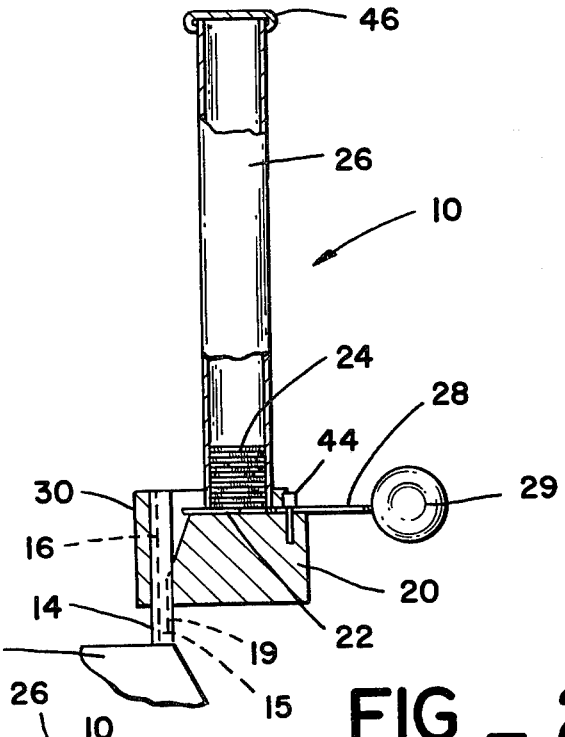
FIG. 2 is an enlarged fragmentary side view in elevation of the coin inlet structure of the slot machine of FIG. 1 with a device according to this invention shown in cross-section as mounted for use on the coin inlet structure.

As best shown in FIG. 2, the coin inlet structure 14 of the slot machine 12 projects upwardly from the top of the machine 12. Basically the coin inlet structure 14 comprises four walls fixed to each other in spaced relation to define a generally rectangular slot 15 dimensioned to receive an upstanding coin and guide its movement in edge-on orientation due to the force of gravity into the operative elements of the slot machine 12. One of the walls 16 defining the slot 15 extends upwardly along one side of the slot 15 to define a generally planar coin guiding surface 17 against which one face of an upstanding coin may be positioned prior to dropping it so that it will fall by gravity into the slot 15. The walls 18 defining the ends of the slot 15 may also extend upwardly to further facilitate the insertion of a coin into the slot 15. Finally, the front wall 19 defining the slot 15 may curve upwardly from the middle toward the opposite ends of the slot 15 to define an arcuate edge for still further facilitating the insertion of a coin into the slot 15 as is well known in the art.

The device 10 according to this invention for feeding coins one at a time from a supply of coins into the slot 15 of the slot machine 12 comprises means 20 defining a first passageway 22 of generally rectangular cross-section dimensioned to pass a coin 24 in edge-on orientation from a supply of such coins in stacked face-to-face orientation. The supply of coins 24 is contained in a tubular reservoir means 26 dimensioned to receive such coins in face-to-face stacked relationship. The tubular axis of the reservoir 26 extends normally to the first passageway 22 defined by the means 20 with one end of the cylindrical reservoir opening into the passageway 22 through one sidewall thereof.

A slide member 28 is received in the first passageway 22 for reciprocating motion therewithin. The slide member is of sufficient length to move a coin received in the first passageway 22 from the reservoir 26 to one end of the first passageway 22 in edge-on orientation while a portion of the slide member 28 projects from the other end of the passageway 22. An appropriate ball 29 or other grip means may be provided on the projecting end of the slide 28 to facilitate the grasping of the slide 28 by the hand of the player in imparting reciprocating motion to the slide 28 to feed coins 24 one at a time from the stack in the reservoir 26 through the passageway 22 in generally horizontal, edge-on orientation.

Figure 3:
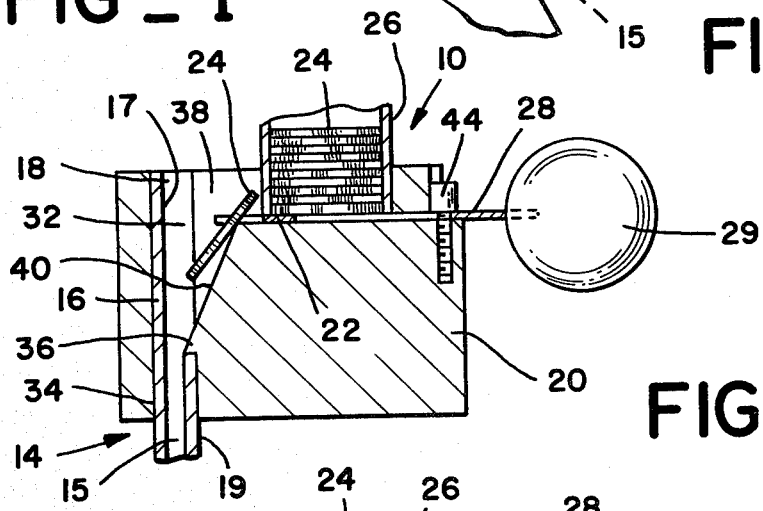
FIG. 3 is an enlargement of a portion of FIG. 2, showing the slide member of a device according to this invention in an intermediate position.
Figure 4:
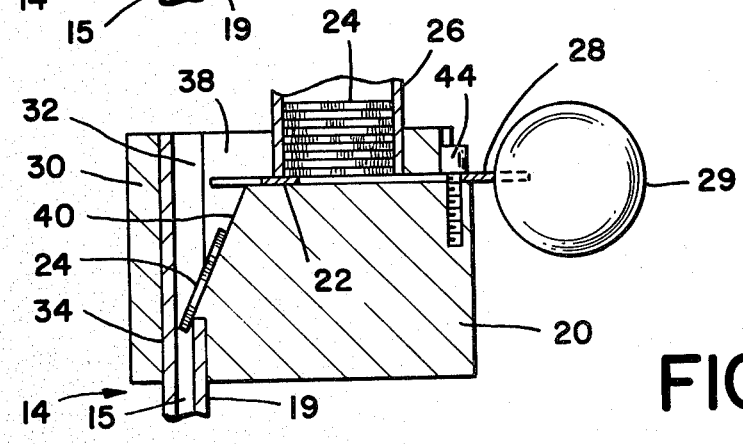
FIG. 4 is identical to FIG. 3 but shows the slide member at the fully operative end of its reciprocating movement.

As best shown in FIGS. 3 and 4, a means 30 which may be integrally formed with the means 20 is provided to define a second passageway 32 communicating with the end of the passageway 22 to which the coins 24 are moved by the slide 28. The second passageway 32 extends transversely of the first passageway 22 and the lower end 34 of the second passageway 32 is dimensioned to receive the coin inlet structure 14 of the slot machine 12 with a sliding fit.

As best shown in FIG. 3, the wall of the second passageway 32 adjacent the reservoir 26 is provided with a stop means 36 adapted to engage the front wall 19 of the coin inlet structure 14 at the edge of the slot 15. The second passageway 32 is generally rectangular having a cross-sectional length sufficient to pass a coin 24 in edge-on orientation and the end 38 of the second passageway 32 at its junction with the first passageway 22 has a cross-sectional width greater than the diameter of a coin 24. The wall of the second passageway 32 adjacent the reservoir preferably recedes smoothly from the opposite wall thereof as indicated at reference numeral 40 beginning at the stop means 36 and ending at its junction with the first passageway 22 at a distance from the opposite wall at least equal to the radius of a coin 24.

Figure 5:
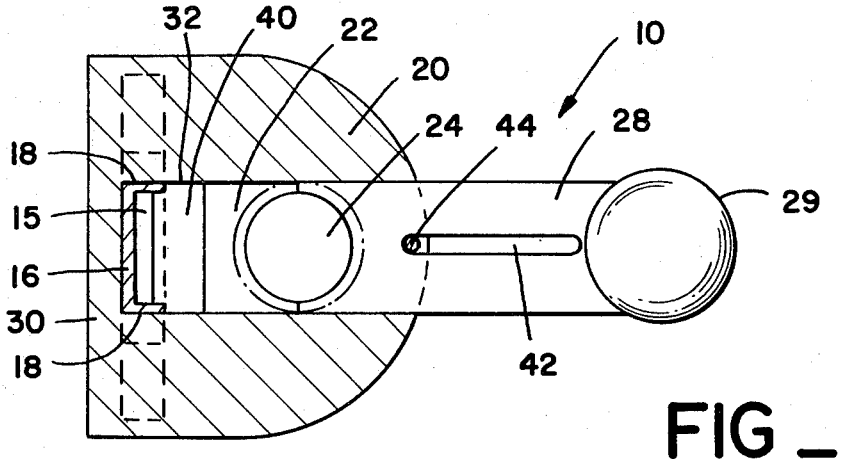
FIG. 5 is an enlarged top plan view of FIG. 2.
Figure 6:
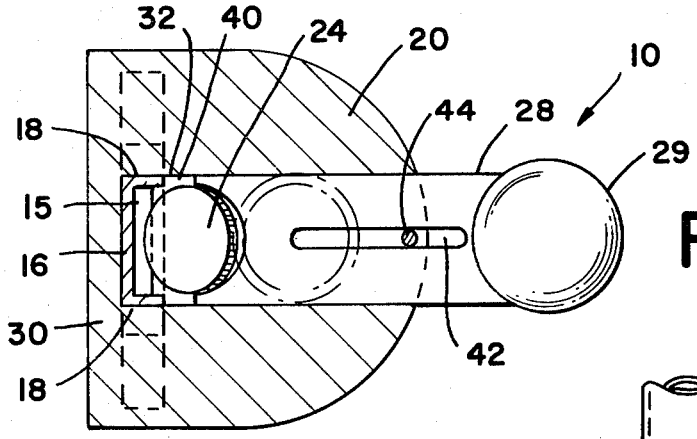
FIG. 6 is a top plan view similar to FIG. 5 but showing the slide member in a position corresponding to that shown in FIG. 3.

As best shown in FIGS. 5 and 6, the slide member 28 is preferably provided with a longitudinally extending slot 42 through which a pin or screw 44 is received into the body 20. Thus, the screw 44 cooperates with the longitudinally extending slot 42 to establish the opposite extremes of the reciprocating motion of the slide member 28. The first extreme of such motion is represented in FIGS. 2 and 5, with the slide member 28 withdrawn from the first passageway 22 to allow a coin 24 to be received in the first passageway 22 from the reservoir 26. In FIGS. 3 and 6, the slide member 28 is shown as moved into the passageway 22 to an intermediate position and in FIG. 4 the slide member 28 is shown as fully received in the passageway 22 to the extent allowed by the longitudinal slot 42 and pin 44.

It will be seen that in the intermediate position in FIGS. 3 and 6, a coin 24 has been moved in edge-on orientation through the first passageway 22 from the reservoir 26 to the second passageway 32 and is in the process of dropping into the second passageway 32 to be guided into the slot 15 upon movement of the slide to its extreme inward position as shown in FIG. 4. The slide member 28 will then be retracted in the passageway 22 to allow a second coin to be received in the passageway 22 from the reservoir 26 and moved by the slide member 28 to the second passageway 32 and the process repeated for each succeeding coin.

Referring to FIGS. 5 and 6, the means 20 defining the first passageway 22 and the means 30 defining the second passageway 32 are preferably molded as an integral unit with the second passageway 32 dimensioned to receive the coin inlet structure 14 of a slot machine 12 in such a way as to removably mount the device 10 on the coin inlet structure 14. Thus, in use, the player need not hold the device 10 instead, but may manipulate the slide member 28 by manually engaging the grip 29 with the left hand while operating the lever of the slot machine 12 with the right hand. If the player wishes to change from one slot machine 12 to another, he may easily remove the device 10 and remount it on the coin inlet structure 14 of the slot machine of his choice. As best shown in FIG. 2, the reservoir 26 may be fitted with a removable cap 46 to enable a roll or stack of coins 24 to be inserted in the reservoir 26. Thus the device may be handled without danger of dropping or spilling the coins 24. The reservoir is, in this embodiment, fixed to the means 20 and the loading of the reservoir 26 may be accomplished at a table or some other convenient location.

Referring to FIGS. 7 through 10, an alternate embodiment 11 of the device according to this invention is shown in which the reservoir is removable so that the operative portion of the device may be left in its mounted position on the coin inlet structure of a slot machine while the reservoir is being reloaded or when the player wishes to depart from the machine for a short period of time for other purposes. To this end, the embodiment 11 of the device according to this invention is provided with a removable reservoir 56.

The removable reservoir 56 comprises a hollow tubular body 60, identical to the tubular body of the reservoir 26, dimensioned to receive a quantity of coins in stacked face-to-face relationship. One end of the tubular body 60 may either be closed or provided with a removable cap similar to the cap 46 of FIG. 2. The other end of the tubular body 60 is provided with a fixed, outwardly projecting cylindrical sleeve or flange structure 62 adapted to be received in a mounting insert 64.

Figure 8:
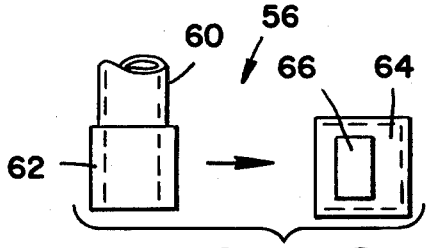
FIG. 8 is an exploded side view in elevation of the end of the reservoir structure of FIG. 7.
Figure 7:
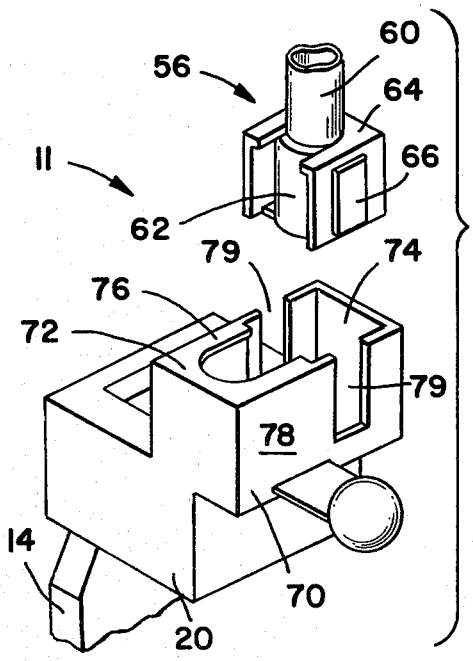
FIG. 7 is an exploded perspective view of an alternate embodiment of this invention.

As best shown in FIG. 7, the mounting insert 64 is a hollow box dimensioned to receive the flange structure 62 through an open side thereof with a channel formed in the top to receive the tubular body 60. The sides of the insert 64 adjacent the open side thereof are each provided with an outwardly projecting tab 66. As best shown in FIG. 8, the mounting insert 64 will close the end of the reservoir 56 when the flange structure 62 on the end of the tubular body 60 of the reservoir 56 is received in the insert 64. Thus, the reservoir 60 may be loaded with coins through either of its ends with the insert 64 preventing the release of such coins through the end of the reservoir 60 which is received therein.

Referring again to FIG. 7. the embodiment 11 of the device according to this invention includes a hollow, rectangular box structure 70 (which may be formed integrally with the means 20) for mounting the removable reservoir structure on the means 20. Thus the top 72 of the hollow rectangular box structure 70 is provided with a first opening 74 dimensioned to receive the mounting insert 64 together with a channel 76 communicating therewith dimensioned to receive the tubular body 60 of the reservoir 56 with the flange structure 62 contained within the box structure. The sides 78 of the rectangular box 70 are provided with channels 79 dimensioned to receive the tabs 66 on the sides of the mounting insert 64.

Figure 9:
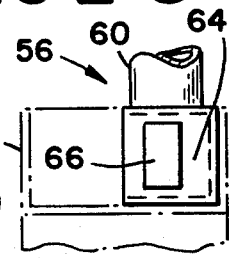
FIG. 9 is a side view in elevation showing the body of the coin feeding device of FIG. 7 in phantom with the end of the reservoir structure of FIG. 7 shown in full as initially inserted therein.
Figure 10:
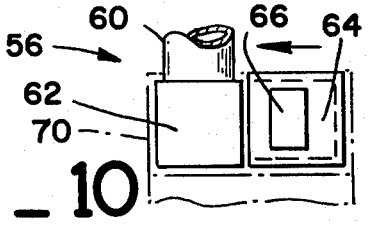
FIG. 10 is a view similar to FIG. 9, but showing the reservoir as moved to its final operative position.

Thus, as best shown in FIGS. 9 and 10, the reservoir 56 with the mounting insert 64 applied thereto may be inserted in the box 70. The tabs 66 on the insert 64 will be received in the channels 79 thereby removably mounting the insert 64. The body 60 of the reservoir 56 may then be moved from the position shown in FIG. 9 to the position shown in FIG. 10 leaving the insert 64 in place. When the reservoir 56 is in the position shown in FIG. 10, it will communicate with the first passageway 22 provided by the means so that coins from a stack of coins contained in the tubular body 60 will be introduced into the passageway 22 as described hereinabove.

It will be seen that when the reservoir 56 is in the position shown in FIG. 10, the player may use the embodiment 11 of this invention as described hereinabove with respect to FIGS. 1 through 6. If a player desires to reload the reservoir 56 or to cease playing a slot machine for a period of time, he may move the reservoir 56 from its position shown in FIG. 10 to its position shown in FIG. 9, and then remove the tubular body 60 of the reservoir 56 with the mounting insert 64 applied thereto from the rectangular box 70. The mounting insert 64 will hold the coins in the tubular body 60 of the reservoir 56 during transportation and the means 20 and 30 of the device 11 may be left in place on the coin inlet structure 14 of the slot machine to reserve the slot machine for subsequent play by the player.

Referring to FIGS. 11 through 13, an embodiment 110 of this invention which may be made an integral part of a slot machine is shown. Thus the means 120 defining the first passageway 122 and the means 130 defining the second passageway 132 may be an integral part of the coin inlet structure 114 of a slot machine (not shown). To this end, the passageway 132 may define the inlet slot 115 of the slot machine or an integral continuation thereof.

The means 120 and 130 could, of course, also be identical to the means 20 and 30 described hereinabove in connection with FIGS. 1 through 10 so that they could be removably mounted on the coin inlet structure of a slot machine 12. Similarly, the passageways 122 and 132, as well as the junction therebetween including the receding wall 140, the slide member 128, grip 129, slot 142 and pin 144 are identical in form and function to the corresponding elements of this invention as shown in FIGS. 1 through 10.

It will be understood that the embodiments 10 and 11 of this invention shown in FIGS. 1 through 6 and 7 through 10, respectively, could also be made integral with a slot machine 12. Thus the principle difference between the embodlment 110 of this invention (shown in FIGS. 11 through 13) and embodiments 10 and 11, is in the structure provided for the removable mounting of the reservoir 156 of the embodiment 110. Thus the reservoir 156 comprises a tubular body 160 closed at one end by a removable cap 146. The other end of the tubular body 160 is closed by a solid plug member 162. The means 120 defining the passageway 122 also defines a socket 164 dimensioned to receive the plug member 162 of the reservoir 156. Such socket 164 extends transversely of the major surfaces of the passageway 122 and the plug member 162 of the reservoir 156 has a passageway 168 formed therethrough which is positioned and dimensioned to provide a continuation of the passageway 122 when the plug member 162 is fully received in the socket 164 and properly positioned as will be more fully described hereinafter.

As best shown in FIG. 12, the passageway 168 in the plug member 162 communicates with the interior of the tubular member 160 of the reservoir 156 so that the bottom one of a stack of coins 24 held in the tubular member 160 in face-to-face relationship will be received in the passageway 168. Referring to FIG. 13, where the plug member 162 and socket 164 are cylindrical in cross section, appropriate indicia 180 and 181 in the form of a groove, for example, may be provided on mating upper surfaces of the plug 162 and means 120 defining the passageway 122 which when brought into alignment with each other will indicate that the passageway 168 in the plug member 162 is in alignment with the passageway 122. When the passageways 122 and 168 are in alignment, the slide member 128 will be received in the passageway 168 from the passageway 122 to enable the movement of a coin 24 from the reservoir 156 and into the junction between the passageway 122 and the passageway 132, as described hereinabove with embodiments 10 and 11.

When the slide member 128 is fully retracted in the passageway 122, the reservoir 156 may be easily mounted and removed by inserting the plug 162 in the socket 164 or removing it therefrom. When the plug 162 is removed from the socket 164, the bottom coin of a stack of coins 24 received in the tubular body 160 of the reservoir 156 may fall out of one of the open ends of the passageway 168 if the reservoir 156 is inclined from the vertical. To prevent the loss of coins 24 from the reservoir 156, a collar 182 is provided as best shown in FIGS. 11 and 12. The collar 182 is dimensioned to be received over the plug member 162 with a slight force fit. Thus, then the plug member 162 of the reservoir 156 is removed from the socket 164, the collar 182 may be forced down over the plug member 162 to cover the open ends of the passageway 168 and prevent coins 24 from falling out of the passageway 168. When the plug member 162 is inserted in the socket 164 the collar 182 will be forced upwardly to expose the open ends of the passageway 168 for operation as described hereinabove.

Although the embodiments 10, 11 and 110 of this invention shown in the drawing include a grip member 29, 129 for manual actuation of the device, it will be understood that other actuation means could be used. For example, the device could be operated electromechanically so that the slide member 28, 128 is caused to reciprocate when the user simply presses a button to close an electrical contact. The slide member 28, 128 could also be actuated pneumatically and its operation could be triggered automatically or semi-automatically by the operation of some part of the slot machine, such as its lever or handle. It is believed that those skilled in the art will make these and other obvious modifications in the preferred embodiments of this invention as shown in the drawing and described hereinabove without departing from the scope of the following claims.

What is claimed is:

1. A device for feeding coins one at a time from a supply of said coins into a slot machine having a coin inlet for receiving said coins one at a time in edge-on position for falling of said coins by gravity into said inlet, said device comprising:

(a) means formed integrally with said coin inlet of said slot machine defining a first passageway of generally rectangular cross-section dimensioned to pass said coins one at a time in edge-on orientation;

(b) means defining a tubular reservoir dimensioned to receive said supply of said coins in face-to-face stacked relationship, the tubular axis of said reservoir extending normally to the major surfaces of said first passageway with one end of said tubular reservoir opening into said first passageway through one of said major surfaces thereof;

(c) means formed integrally with said coin inlet of said slot machine defining a second passageway of generally rectangular cross-section communicating with one end of said first passageway and dimensioned to pass said coins one at a time in edge-on orientation, said second passageway extending transversely of said major surfaces of said first passageway and the end of said second passageway remote from said first passageway communicating with said coin inlet of said slot machine; the junction between said first and second passageways being dimensioned to allow the faces of said coins to pivot by about 90° within said junction, said (d) a slide member received in the other end of said first passageway for reciprocating motion therewithin, said slide member being of sufficient length to move a coin received in said first passageway from said reservoir into said junction between said first and second passageways.

2. A device as claimed in claim 1 wherein said reservoir is fixedly mounted on said means defining said first passageway.

3. A device as claimed in claim 1 wherein said reservoir is removably mounted on said means defining said first passageway.

4. A device as claimed in claim 1 wherein said means defining said second generally rectangular passageway is formed integrally with said means defining said first passageway.

5. A device as claimed in claim 1 wherein said wall of said second passageway on the side thereof adjacent said reservoir recedes from the other wall of said second passageway in a smooth planar fashion to a distance greater than the radius of said coins at the point of intersection thereof with the first wall of said first passageway and then abruptly to a distance greater than the diameter of said coins at the point of intersection thereof with the second wall of said first passageway.

6. A device for feeding coins one at a time from a supply of said coins into a slot machine having an upwardly projecting coin inlet structure with a slot for receiving upstanding ones of said coins and a generally planar coin guiding surface projecting upwardly along one side of said slot against which a face of upstanding ones of said coins may be positioned for falling of the coin by gravity into said slot, said device comprising:

a. means defining a first passageway of generally rectangular cross-section dimensioned to pass coins from said supply one at a time in edge-on orientation;

b. means defining a tubular reservoir dimensioned to receive said supply of said coins in face-to-face stacked relationship, the tubular axis of said reservoir extending normally to said first passageway with one end of said tubular reservoir opening into said passageway through one side thereof;

c. means defining a second generally rectangular passageway having one end communicating with one end of said first passageway, said second passageway extending transversely of said first passageway and the other end thereof being dimensioned to receive said upwardly projecting coin inlet structure of said slot machine with a sliding fit, the wall of said second passageway on the side thereof adjacent said reservoir providing a stop means for abutment with said coin inlet structure and receding from the other wall of said second passageway from said stop means to a distance greater than the diameter of said coins at the junction between said first and second passageways; and d. a slide member received in the other end of said first passageway for reciprocating motion therewithin and being of sufficient length to move a coin received in said first passageway from said reservoir out of said one end of said first passageway.

7. A device as claimed in claim 6 wherein said sliding fit between said second passageway and said coin inlet structure of said slot machine is adapted to removably mount said device on said slot machine.

8. A device as claimed in claim 3 wherein said reservoir is provided with an outwardly projecting flange structure at one end thereof and said means defining said first passageway is provided with means for receiving said flange structure to removably mount said reservoir on said body in communication with said first passageway.

9. A device as claimed in claim 8 including a mounting insert for engagement with said outwardly projecting flange structure of said reservoir, said mounting insert comprising a hollow structure dimensioned to receive said flange structure, said structure being open at one side and having a channel formed in an adjacent side communicating with said open side dimensioned to receive the cross-section of said reservoir, whereby said mounting insert closes the end of said reservoir when applied thereto.

10. A device as claimed in claim 9 wherein said means for receiving said flange structure comprises a hollow rectangular box structure formed integrally with said body having one end dimensioned to receive said mounting insert, said one end having an open top for receiving said mounting insert, the other end of said hollow rectangular box structure having a channel dimensioned to receive the cross-section of said reservoir formed in the top thereof communicating with said open top of said one end of said box structure and means for retaining said mounting insert in said one end of said box structure, whereby said reservoir with said mounting insert applied thereto may be inserted in said one end of said box structure and then moved to the other end of said box structure leaving said mounting insert in place in said one end of said box structure.

11. A device as claimed in claim 3 wherein said tubular reservoir is provided with an integral solid plug member at one end thereof and said means defining said first passageway also defines a socket extending transversely of said first passageway, said socket being dimensioned to receive said solid plug member of said reservoir and said solid plug member of said reservoir defining a passageway dimensioned and oriented to provide a portion of said first passageway when said plug member is fully received and aligned within said socket.

12. A device as claimed in claim 11 wherein said tubular reservoir is provided with a collar dimensioned to be received over said plug member thereby closing the open ends of said passageway defined by said plug member.

* * * * *